US005497865A

United States Patent [19]

Yun-Pi

[11] Patent Number: 5,497,865

[45] Date of Patent: Mar. 12, 1996

[54] RETRACTABLE TRAVEL BAG HANDLE ASSEMBLY

[76] Inventor: Wu Yun-Pi, 5 Fl., 31, Alley 25, Lane 90, Sec. 6, Min Chuan E. Rd., Taipei, Taiwan

[21] Appl. No.: 307,460

[22] Filed: Sep. 19, 1994

[51] Int. Cl.[6] ..... A45C 5/14; A45C 13/04; A45C 13/26

[52] U.S. Cl. ..... 190/115; 190/39; 190/18 A; 16/115; 280/37

[58] Field of Search ..... 190/18 A, 39, 190/115, 117; 16/112, 115; 280/37, 47.315, 47.371, 655, 655.1

[56] References Cited

U.S. PATENT DOCUMENTS

| | | | |
|---|---|---|---|
| 2,510,754 | 6/1950 | Norlin | 190/18 A X |
| 3,606,372 | 9/1971 | Browning | 190/115 X |
| 3,799,568 | 3/1974 | Hager | 190/18 A X |
| 4,358,005 | 11/1982 | Fontana | 190/18 A |
| 4,411,343 | 10/1983 | Cassimally et al. | 190/115 X |
| 4,616,379 | 10/1986 | Lio | 190/117 X |
| 5,048,649 | 9/1991 | Carpenter et al. | 190/115 X |
| 5,167,306 | 12/1992 | Carrigan, Jr. | 190/18 A |
| 5,323,887 | 6/1994 | Scicluna et al. | 190/115 X |
| 5,339,934 | 8/1994 | Liang | 190/115 X |

FOREIGN PATENT DOCUMENTS

| | | | |
|---|---|---|---|
| 2632262 | 12/1989 | France | 190/18 A |
| 2661807 | 11/1991 | France | 190/18 A |

*Primary Examiner*—Sue A. Weaver
*Attorney, Agent, or Firm*—Bacon & Thomas

[57] ABSTRACT

A retractable travel bag handle assembly includes a retractable handle moved in and out of two cylindrical casings fixed to the inside of a travel bag, two socket caps mounted on the travel bag and connected to the cylindrical casings to prevent disconnection of the retractable handle from the cylindrical casings, wherein the retractable handle consists of two sleeves respectively coupled to the cylindrical casings by movable couplings and a substantially U-shaped handlebar having two opposite ends moved in and out of the sleeves, each movable coupling including a base block having two square projections at two opposite sides moved in two hollow side wings along the cylindrical casings, and a connecting rod having one end fixedly connected to one sleeve and an opposite end pivotably connected to the base block by a pivot for allowing the retractable handle to be turned relative to the travel bag to change the steering direction.

1 Claim, 4 Drawing Sheets

RETRACTABLE TRAVEL BAG HANDLE ASSEMBLY

BACKGROUND OF THE INVENTION (a) Field of the Invention:

The present invention relates to a retractable handle assembly for a travel bag or luggage which is simple and inexpensive and, which is practical and comfortable in use.

(b) Description of the Prior Art:

There is known a travel bag carrying handle that can be received in a hole inside one vertical side panel of the travel bag when not in use, or pulled out of the travel bag for carrying by hand to move the travel bag on the ground. Because this carrying handle is commonly made of flexible leather or cloth in the form of a loop, it is difficult to control the steering direction of the travel bag when the travel bag is pulled by hand through the carrying handle, and the travel bag may fall easily when it is turned from one direction to another. Furthermore, the length of the carrying handle is limited to the length of the vertical side panel of the travel bag, therefore the user cannot grasp the carrying handle without bending the body. However, the user's waist and back will ache quickly when the user bends the body to pull the travel bag on the ground through the carrying handle. There are also known retractable travel bag handles made in a telescopic form for mounting on the outside of travel bags or luggage These retractable travel bag handles are functional, however they are commonly complicated and difficult to install, and they need much installation space. Furthermore, these retractable travel bag handles destroy the sense of beauty of the travel bags because they are disposed outside the travel bags when installed.

SUMMARY OF THE INVENTION

The present invention has been accomplished to provide a retractable travel bag handle assembly which eliminates the aforesaid drawbacks. According to one aspect of the present invention, the retractable travel bag handle assembly comprises a base frame fixed to a travel bag on the inside and having two receptacles, two cylindrical casings joined by a cross frame and connected to the receptacles by locating pins, a retractable handle consisting of two sleeves respectively coupled to the cylindrical casings by movable couplings inside the cylindrical casings, and a substantially U-shaped handlebar having two opposite ends moved in and out of the sleeves, and two socket caps respectively fastened to the travel bag and connected to the cylindrical casings to stop the movable couplings in the cylindrical casings.

According to another aspect of the present invention, the base frame, the cylindrical casings, and the retractable handle are received inside the travel bag with only the transverse handgrip of the U-shaped handlebar closely attached to the outside wall of the travel bag when the retractable handle is collapsed.

According to still another aspect of the present invention, the cylindrical casings each have two opposite hollow side wings along the length, the movable couplings have square projections moved along the side wings of the cylindrical casings, and therefore the retractable handle does not oscillate when moved.

According to still another aspect of the present invention, the movable couplings each comprise a base block having two square projections at two opposite sides moved in two hollow side wings along the cylindrical casings, and a connecting rod having one end fixedly connected to one sleeve and an opposite end pivotably connected to the base block by a pivot. Therefore, when the retractable handle is fully extended out of the travel bag, it can be turned relative to the base blocks of the movable couplings to change the steering direction in a stable manner.

DETAILED DESCRIPTION OF THE PREFERRED EMBODIMENT

Figure 1:
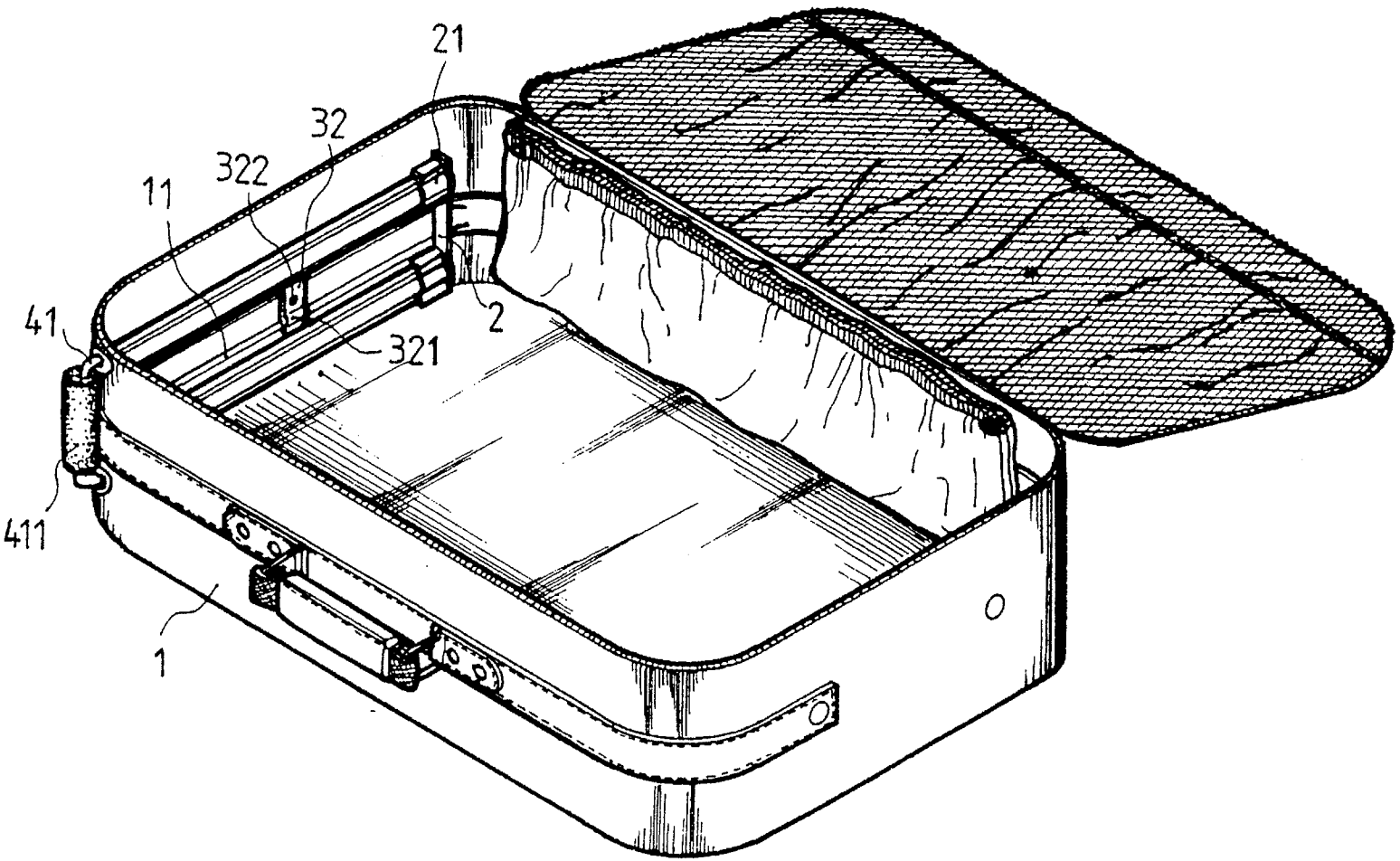
FIG. 1 shows a retractable travel bag handle assembly installed in a travel bag.
Figure 2:
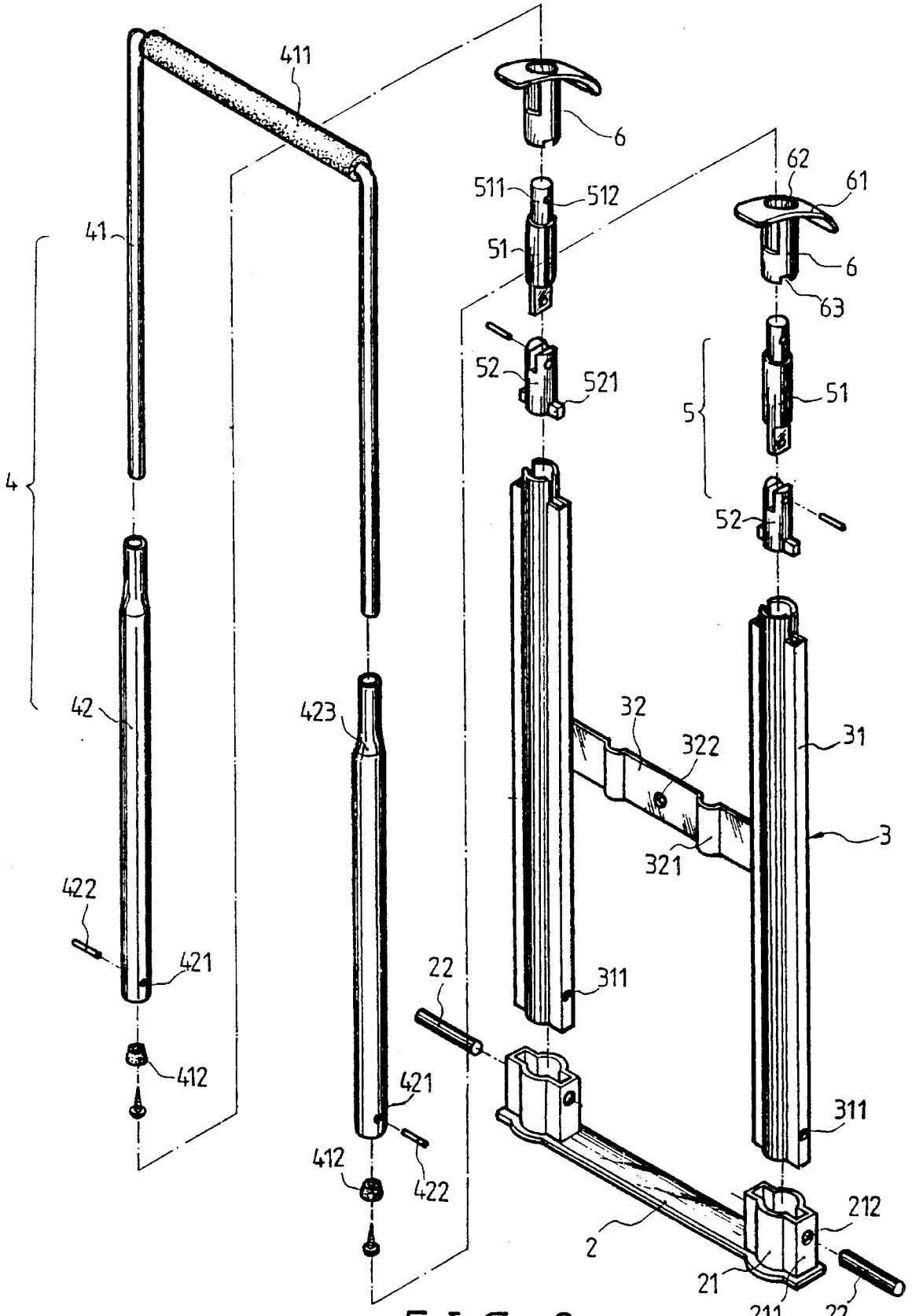
FIG. 2 is an exploded view of the retractable travel bag handle assembly shown in FIG. 1.

Referring to FIGS. 1 and 2, a retractable travel bag handle assembly in accordance with the present invention is generally comprised of a base frame 2 fixed to the inside of a travel bag 1 at one side and having two receptacles 21, two cylindrical casings 3 joined in parallel by a cross frame 32 and fixed to the inside wall of the travel bag 1 and each having one end respectively connected to the receptacles 21 and an opposite end mounted with a respective socket cap 6, and a retractable handle 4 inserted through the socket caps 6 into the cylindrical casings 3 and coupled with two movable couplings 5 inside the cylindrical casings 3.

The receptacles 21 of the base frame 2 each have two opposite hollow side wings 211 and a transverse pin hole 212 through the hollow side wings 211. The cylindrical casings 3 are identical, each having two opposite hollow side wings 31 bilaterally disposed along the length and a pin hole 311 transversely disposed near the respective bottom end. The cross frame 32 is connected between the cylindrical casings 3, having a center rivet hole 322 and two arched portions 321 transversely disposed in parallel between the center rivet hole 322 and the cylindrical casings 3. The retractable handle 4 comprises a substantially U-shaped handlebar 41 and two sleeves 42. The U-shaped handlebar 41 comprises a transverse handgrip 411 having two angled opposite ends respectively inserted into the sleeves 42 and coupled with a respective rubber stopper 412. The sleeves 42 are respectively received in the cylindrical casings 3, each having a top end terminating in a reduced diameter 423 and a bottom end made with a transverse pin hole 421. The movable couplings 5 are identical, each comprised of a connecting rod 51 and the base member 52. The connecting rod 51 has a top end terminating in a stepped rod section 511 with a transverse pin hole 512 and a bottom end pivoted to the base block 52. The base block 52 has two square projections 521 bilaterally disposed at the bottom. The socket caps 6 are identical, each having a longitudinal through hole 62, two opposite bottom notches 63, and a curved top flange 61.

Figure 3:
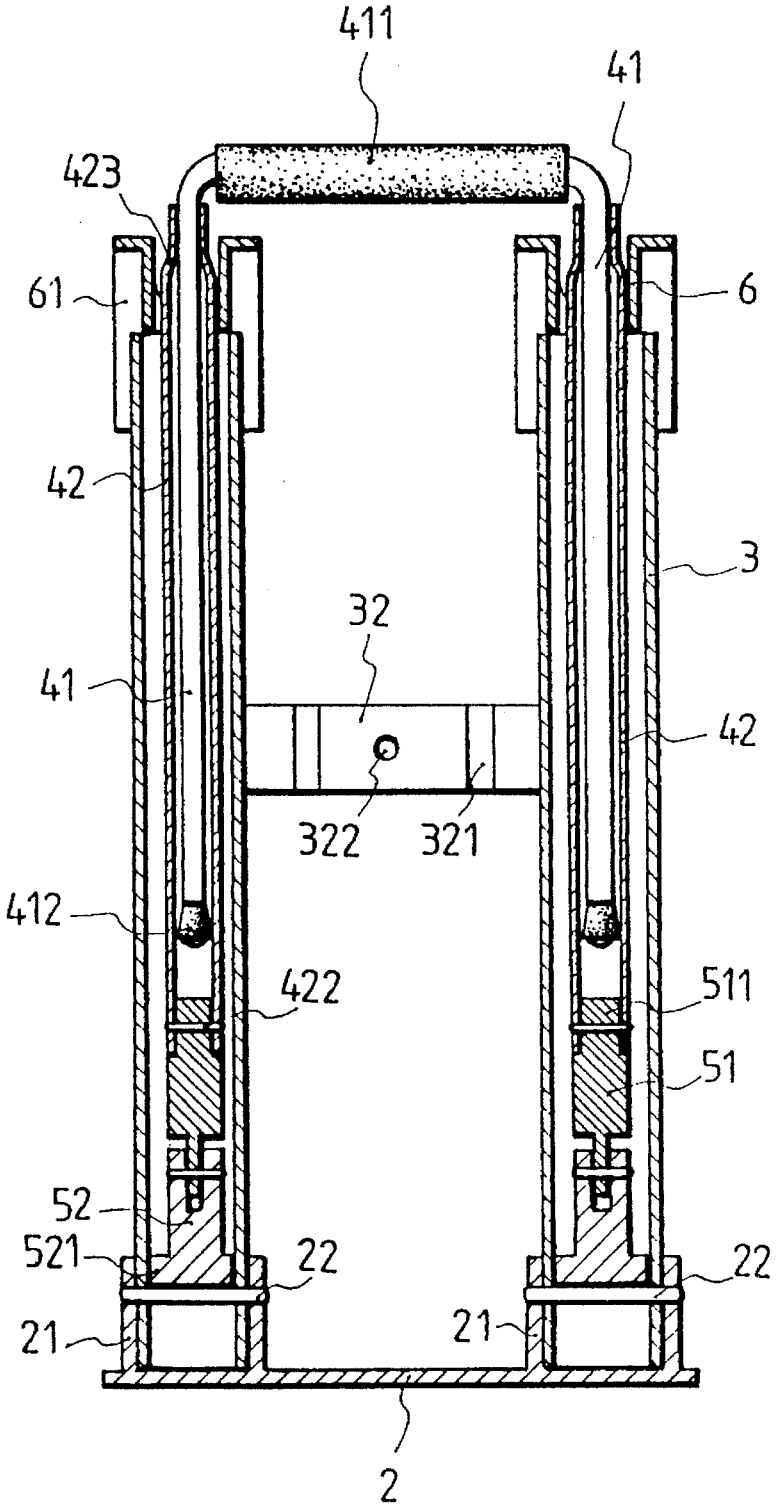
FIG. 3 is a longitudinal view in section of the retractable travel bag handle assembly shown in FIG. 1.

The assembly process of the retractable travel bag handle assembly is outlined hereinafter with reference to FIGS. 1, 2, and 3. The cylindrical casings 3 are respectively fastened to the receptacles 21 of the base frame 2 by fitting locating pins 22 into the pin holes 212 on the receptacles 21 and the pin holes 311 on the cylindrical casings 3. Then, the rivet hole 322 of the cross frame 32 is fixed to the travel bag 1 at a suitable location by a rivet (not shown), permitting the arched potions 321 to bridge over respective reinforcing ribs 11 on the travel bag 1. Then, the sleeves 42 of the retractable handle 4 are respective inserted through the longitudinal through holes 62 of the socket caps 6 and coupled to the stepped rod sections 511 of the connecting rods 51 of the movable couplings 5 by fitting locating pins 422 into the pin holes 421 on the sleeves 42 and the pin holes 512 on the stepped rod sections 511. After the sleeves 42 of the retractable handle 4 and the movable couplings 5 are inserted into the cylindrical casings 3, the socket caps 6 are fastened to the travel bag 1 and connected to the cylindrical casings 3, permitting the top flanges 61 to be covered on the outside wall of the travel bag 1. When installed, the square projections 521 of the base blocks 52 of the movable couplings 5 are moved in the hollow side wings 211 of the receptacles 21 and the hollow side wings 31 of the cylindrical casings 3.

When the retractable handle 4 is collapsed, as shown in FIG. 1, the handgrip 411 is closely attached to the outside wall of the travel bag 1. When the handlebar 41 is pulled out of the sleeves 42, the rubber stoppers 412 stopped at the reduced diameters 423 of the sleeves 42 on the inside, and therefore the handlebar 41 does not disconnect from the sleeves 42. When the sleeves 42 are pulled out of the cylindrical casings 3, the square projections 521 of the base blocks 52 are stopped at the bottom notches 63 on the socket caps 6, and therefore the sleeves 42 do not disconnect from the cylindrical casings 3.

Figures 4, 5:
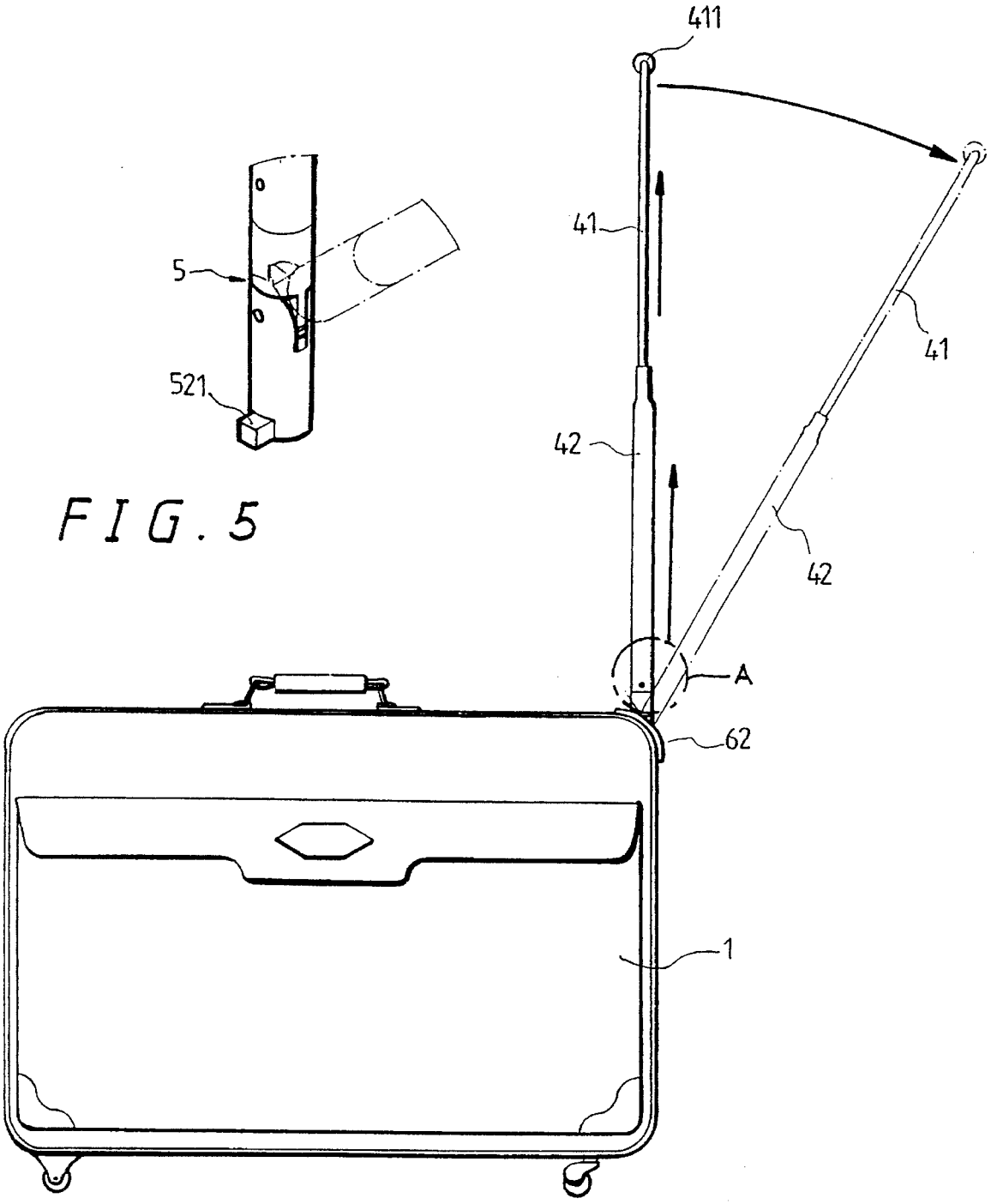
FIG. 4 shows the retractable handle of the retractable travel bag handle assembly of FIG. 1 extended out of the travel bag and turned relative to the travel bag.
FIG. 5 is a partial enlarged view of area A in FIG. 4.

Referring to FIG. 4, when the retractable handle 4 is fully extended out of the cylindrical casings 3, it can be turned relative to the travel bag 1 (because the sleeves 42 are fixed to the connecting rods 51, the connecting rods 51 are pivoted to the base blocks 52, and the base blocks 52 are stopped by the socket caps 6 inside the cylindrical casings 3).

While only one embodiment of the present invention has been shown and described, it will be understood that various modifications and changes could be made without departing from the spirit and scope of the invention.

What is claimed is:

1. A retractable travel bag handle assembly comprising:

a base frame fixed to an inside wall of a travel bag and having two receptacles, each receptacle having two hollow side wings at two opposite sides;

two cylindrical casings joined by a cross frame and connected to said receptacles of said base frame by connecting means including locating pins, each cylindrical casing having two hollow side wings at two opposite sides respectively longitudinally aligned with the hollow side wings on said receptacles;

a retractable handle consisting of two sleeves respectively coupled to said cylindrical casings by a respective movable coupling inside said cylindrical casings, and a substantially U-shaped handlebar having two opposite ends dimensioned for movement in and out of said sleeves, said movable coupling comprising a base block having two square projections, each projection disposed at an opposite side and dimensioned for movement in the hollow side wings of said receptacles and said cylindrical casings, and a connecting rod including means for fixedly connecting one end to one sleeve and an opposite end pivotably connected to said base block by a pivot; and two socket caps each cap having an opening dimensioned to receive one of said sleeves and corresponding connecting rod and including means for fastening to said travel bag and means for connection to one of said cylindrical casings and dimensioned to stop said base block of said movable coupling in each cylindrical casing, each socket cap having a curved top flange covered on said travel bag on the outside.

* * * * *